United States Patent [19]

Mueller et al.

[11] 4,050,635

[45] Sept. 27, 1977

[54] METHOD AND APPARATUS FOR RECLAIMING SAND

[75] Inventors: Edward E. Mueller, Tonka Bay; Thomas H. Painter, Bloomington; Michael K. Harrod, St. Paul, all of Minn.

[73] Assignee: Whirl-Air-Flow Corporation, Minneapolis, Minn.

[21] Appl. No.: 715,911

[22] Filed: Aug. 19, 1976

[51] Int. Cl.[2] ..... B02C 23/16

[52] U.S. Cl. ..... 241/24; 241/30; 241/69; 241/72; 241/DIG. 10

[58] Field of Search ..... 241/24, 26, 29, 30, 241/69, 70, 71, 72, 76, 79.2, 79.3, 152 R, 152 A, DIG. 10

[56] References Cited

U.S. PATENT DOCUMENTS

| | | | |
|---|---|---|---|
| 788,675 | 5/1905 | Rissmuller | 241/79 |
| 1,120,343 | 12/1914 | Spaulding | 241/70 |
| 1,524,871 | 2/1925 | Lindhard | 241/71 |

*Primary Examiner*—Granville Y. Custer, Jr.

*Attorney, Agent, or Firm*—Merchant, Gould, Smith, Edell, Welter & Schmidt

[57] ABSTRACT

Method and apparatus for reclaiming sand from foundry molds and forms. A drum is mounted in a frame for rotation about its longitudinal axis. The frame is hinged at its rearward end so that the longitudinal axis of the drum may be adjustably inclinedfrom the horizontal. The drum is provided with first and second breaking zones for reducing large pieces of material in the drum as the drum rotates. The first breaking zone contains longitudinal rib members and spikes attached thereto while the second breaking zone contains longitudinal rib members only. A perforate partition separates the first and second breaking zones and prevents the movement of material from the first breaking zone to the second breaking zone until it has been sufficiently reduced. There is also provided a grinding zone for further reducing particles having a predetermined maximum size by means of grinding balls. Various sizing screens are provided for classifying the material being reclaimed into a finished product having a predetermined maximum size and oversized particles.

8 Claims, 7 Drawing Figures

METHOD AND APPARATUS FOR RECLAIMING SAND

BACKGROUND OF THE INVENTION

1. Field of the Invention

This invention relates to a method and apparatus for reclaiming sand from foundry molds and the like whereby a finished product consisting of particles having a predetermined maximum size is obtained which may be then reused.

2. Description of the Prior Art

In the foundry industry, it has long been known to use sand molds for casting. Typically, the sand molds are a mixture of sand and resin (or sand otherwise chemically bonded) which is tailored to form a mold for a particular item to be cast. Once an item has been cast in a mold, the mold must be broken to remove it from around the item.

Rather than discard the broken molds, it has long been known in the foundry industry to recycle these molds to reclaim the sand. Once that is accomplished, the reclaimed sand may be used in further molds.

The devices developed to accomplish this has been of several types. Typically, they have utilized drums mounted for rotation. Some used grinding media such as metallic balls which would grind the material into finer particles upon rotation of the drum. Others used rib members within the drum to elevate the material as the drum rotated until the material reached the top portion of the drum whereupon the material, by action of gravity, would fall through the interior of the drum into the bottom portion of the drum. The impact of the fall helped break down the material.

The devices utilizing grinding balls work best on finer material rather than the larger chunks. The devices utilizing the rib members work best on the larger chunks due to their size. Consequently, many of the devices of the prior art utilized various combinations and configurations of each of these two types of devices.

SUMMARY OF THE INVENTION

The present invention utilizes many of the elements of the prior art devices in a unique combination. The method and apparatus for reclaiming sand are particularly well suited for recycling foundry molds made of sand and resin.

A drum is mounted on a frame for rotation about its longitudinal axis. This axis generally will be given a slight incline from the horizontal in order to induce a material flow within the drum from one end of the drum containing an inlet to the other end of the drum containing an outlet. The incline is made adjustable by pivoting the frame about one of its ends. The rate of material flow through the drum may then be controlled by controlling the angle of the incline. The rate at which the drum is rotated may also be varied.

The interior of the drum defines a chamber which is divided into various subchambers wherein several different operations take place simultaneously. The first subchamber of the drum contains a plurality of rib members spaced peripherally around the interior wall of the drum and extending longitudinally of the drum. The first subchamber of the drum is divided into a first breaking zone and a second breaking zone by means of a perforate partition located within the first subchamber of the drum. That portion of each of the rib members located within the first breaking zone contains a plurality of spikes or projections extending radially inward of the drum. The perforate partition prevents the material contained within the first breaking zone from entering into a second breaking zone until it has been reduced to at least a certain predetermined first maximum size. The breakdown of the material continues in the second breaking zone.

Located rearwardly of the second breaking zone is a grinding zone defined in part by a first sizing screen. The first sizing screen prevents the passage of material from the second breaking zone into the grinding zone until that material has been reduced to at least a certain predetermined second maximum size. Located within the grinding zone are a plurality of grinding balls.

Located rearwardly of the grinding zone are further classifying screens which classify the material being reclaimed into a finished product and a portion containing oversized particles. The finished product and the oversize are separately discharged from the drum and the oversize may be reintroduced into the drum for further processing.

Airflow through the drum is induced by a vacuum pump communicating with the interior of the drum so that dust may be transported out of the drum and into a dust collector.

DETAILED DESCRIPTION OF THE DRAWINGS

Figure 1:
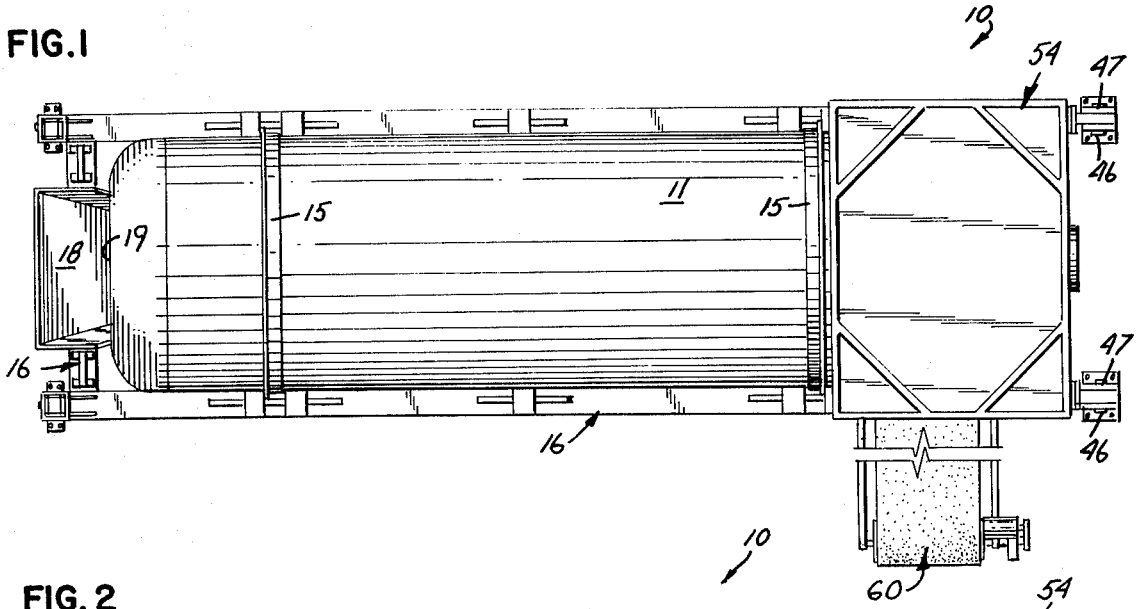
FIG. 1 is a top plan view of the sand reclaiming apparatus.
Figure 2:
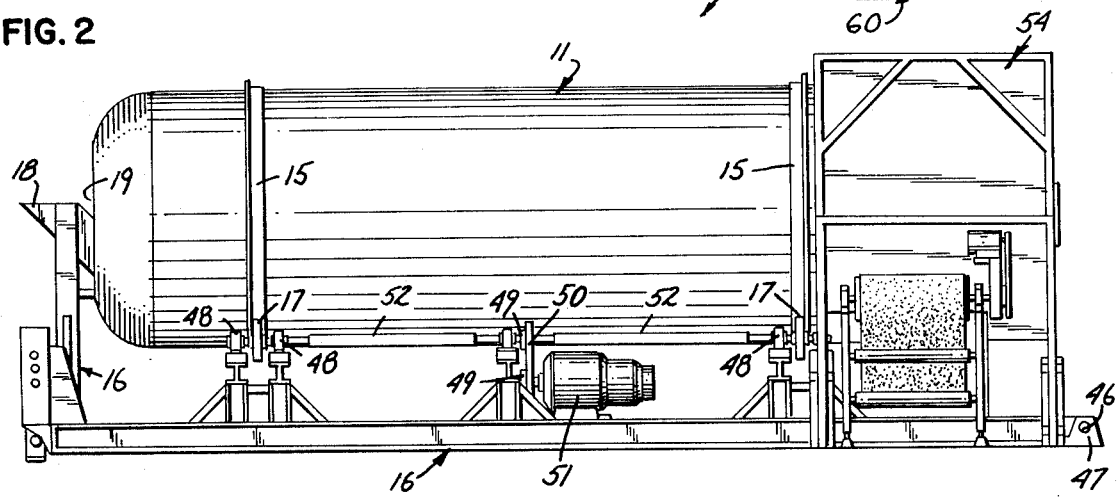
FIG. 2 is a view in side elevation of the sand reclaiming apparatus.

Referring to the drawings, wherein like numerals represent like parts, the sand reclaiming apparatus is generally designated at 10. The apparatus 10 comprises a cylindrical drum 11 defining a chamber 12 having first and second subchambers 13 and 14, respectively. That portion of the drum 11 defining the first subchamber shall be considered to be the front portion of the drum 11 while that portion of the drum 11 defining the second subchamber shall be considered to be the rear portion of the drum 11. The drum 11 is provided with two L-shaped bearing flanges 15 extending around its outer circumference, one of the L-shaped bearing flanges 15 being located around the front portion of the drum 11 and the other L-shaped bearing flange being located around the rear portion of the drum 11.

The drum 11 is mounted upon a support frame 16 for rotation about its longitudinal axis. The support frame 16 supports the drum 11 in such a position that its longitudinal axis is slightly inclined from the horizontal so as to be downwardly inclined from front to rear. The frame 16 is pivoted for movement about one end by means of pins 46 attached to the frame 16 and held in bearings 47. The incline of the frame and thus the drum may thereby be adjusted to provide for various flow rates of material through the drum 11.

The frame 16 includes two pairs of wheels mounted in bearings 48 for rotation about axes parallel to the longitudinal axis of drum 11. One pair of the wheels is disposed on each side of the frame 16. The first pair of wheels (not shown) are free rolling. The second pair of wheels 17 are connected to a connecting shaft 52 which is driven by a motor 51 by means of pulleys 49 and pulley belt 50. The wheels are spaced such that when drum 11 is supported by frame 16 one wheel from each pair engages each of the L-shaped bearing flanges 15 so that when wheels 17 are rotated a rotational movement is imparted to the drum 11. The size of the wheels may be altered to vary the speed at which the drum is rotated.

Located at the front end of the drum 11 is an inlet chute 18 extending through an inlet port 19 located at the front end of the drum 11. The inlet chute 18 is attached to and supported by the frame structure 16.

Figure 3:
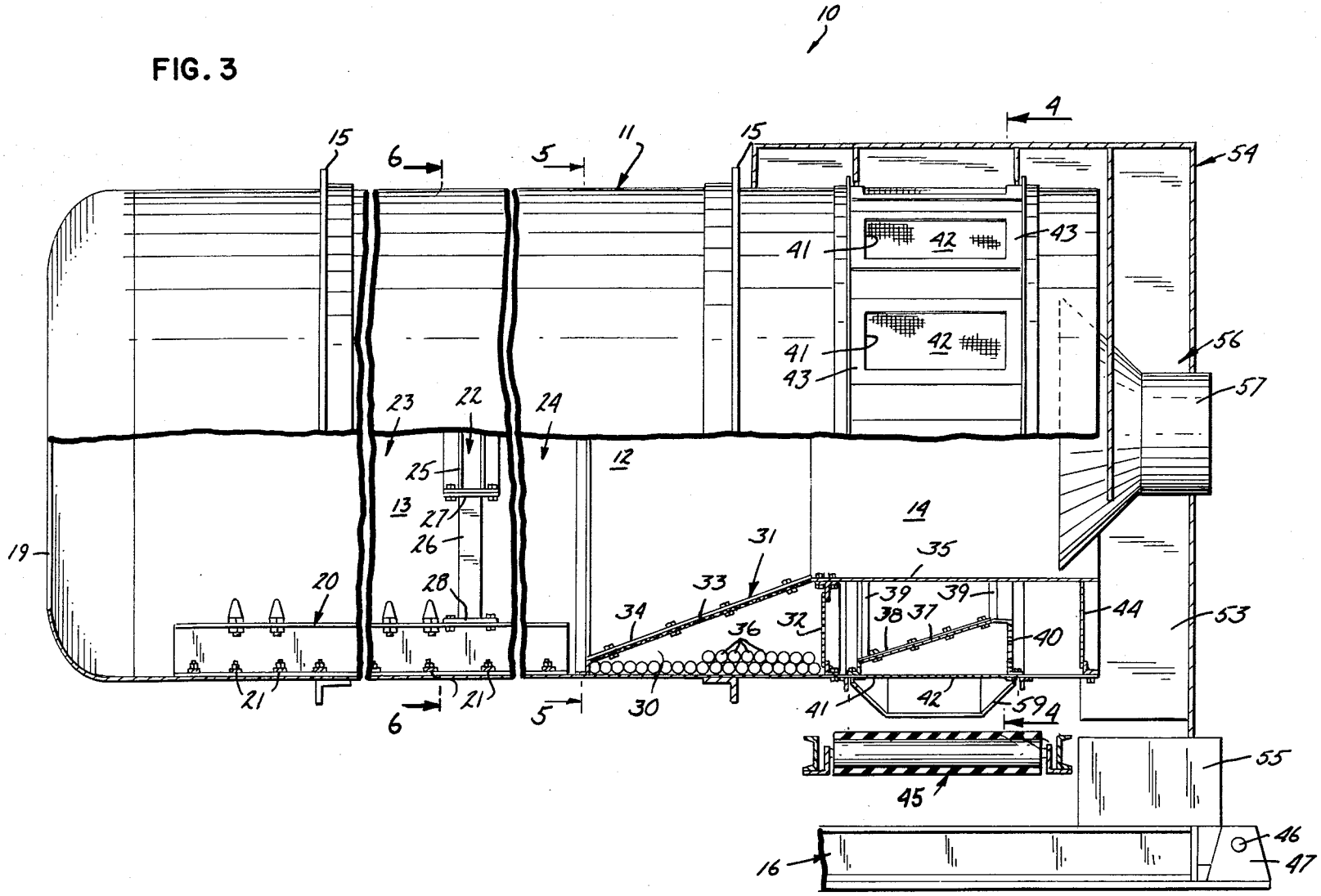
FIG. 3 is a view in side elevation of the drum with portions thereof broken away and/or shown in section.
Figure 4:
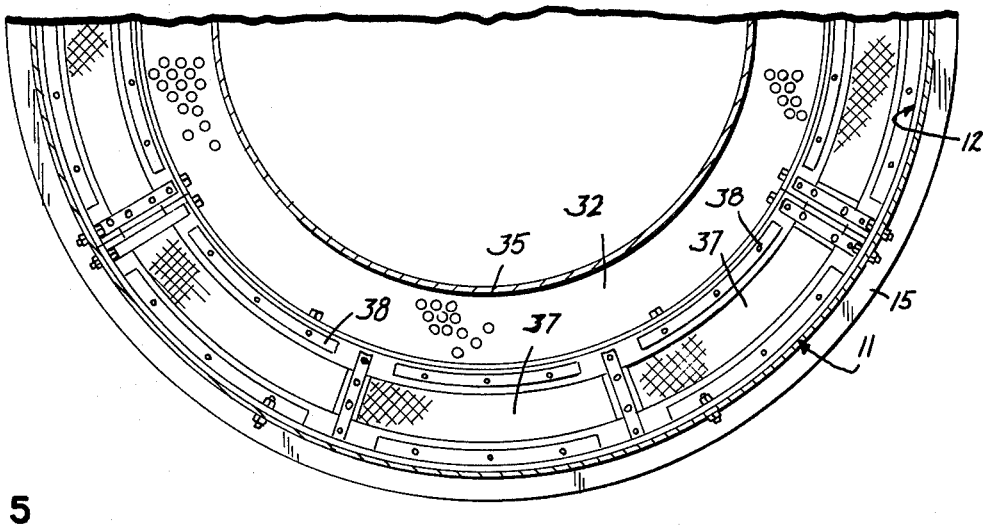
FIG. 4 is a sectional view taken generally along the line 4—4 of FIG. 3 with portions thereof broken away.
Figure 5:
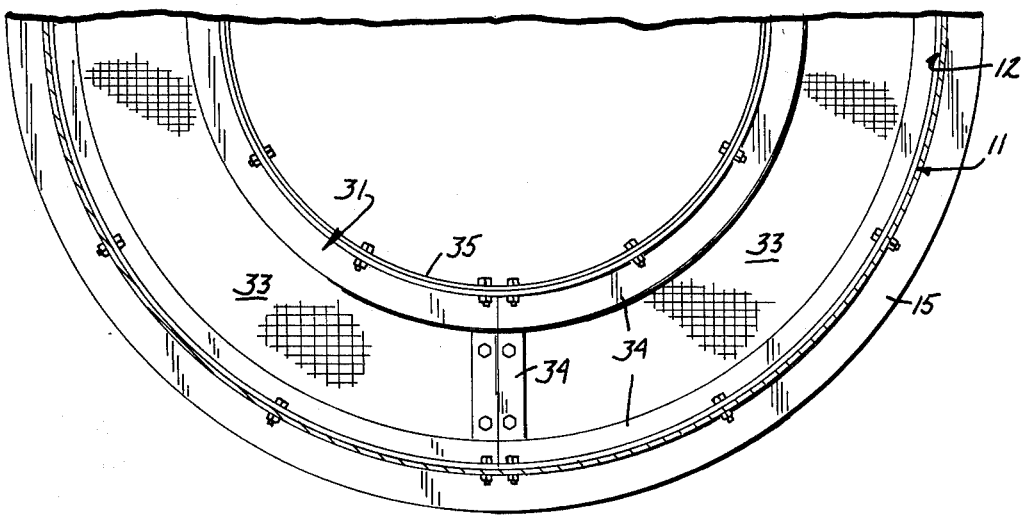
FIG. 5 is a sectional view taken generally along the line 5—5 of FIG. 3 with portions thereof broken away.

FIG. 3 illustrates the interior arrangement of the drum 11. The first subchamber 13 contains a plurality of rib members 20 which extend longitudinally of the drum 11 and are circumferentially spaced about the interior periphery of the drum 11. In the preferred embodiment, the rib members 20 consist of I-beams attached to the interior wall of the drum 11 by means of fastening plates 21 bolted to the interior of the drum 11.

Figure 6:
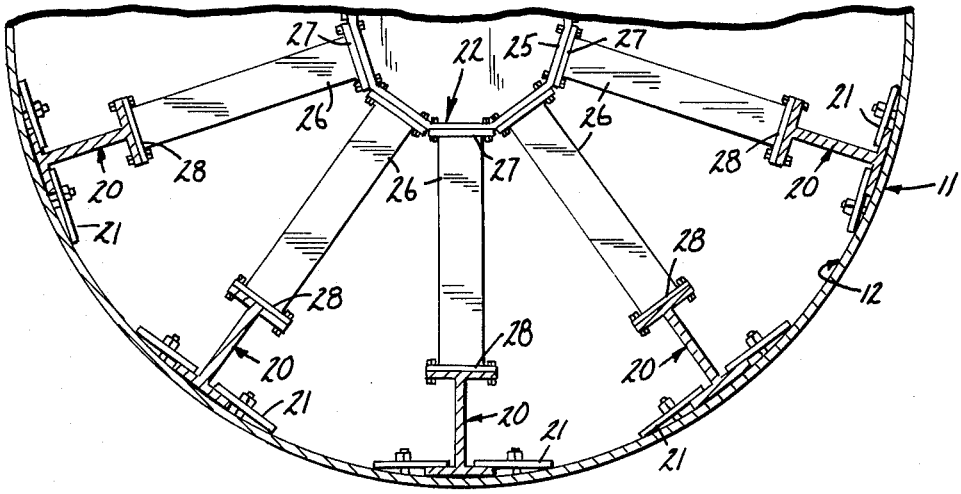
FIG. 6 is a sectional view taken generally along the line 6—6 of FIG. 3 with portions thereof broken away.

A perforate partition 22 is located intermediately of the first subchamber 13 of the drum 11. The partition 22 divides the first subchamber 13 into first and second breaking zones 23 and 24, the first breaking zone 23 being located forwardly of the second breaking zone 24. In the preferred embodiment, the partition 22 takes the shape of a spider having a central hub 25 located centrally of the drum 11. Extending radially outward from the hub 25 are a plurality of arms 26 each having an inward end 27 and an outward end 28. The arms 26 are equally spaced around the hub 25. The inward end 27 of each arm 26 is attached to the hub 25 by bolting or some other appropriate means. The outer end 28 of each arm 26 is attached to a corresponding rib member 20 by bolting or some other appropriate means, so that one arm 26 is associated with each rib member 20, as shown in FIG. 6. It is contemplated that the arms 26 be readily removeable so that, by omitting alternate arms 26, larger chunks of material will be permitted passage into the second breaking zone 24, or, alternatively, arms 26 having a greater width may be installed thereby restricting further the size of chunks which will be capable of passing through the partition 22. By choosing the type of arm 26 placed in the partition 22, the partition 22 may be adapted for use with a wide variety of mold sizes.

Figure 7:
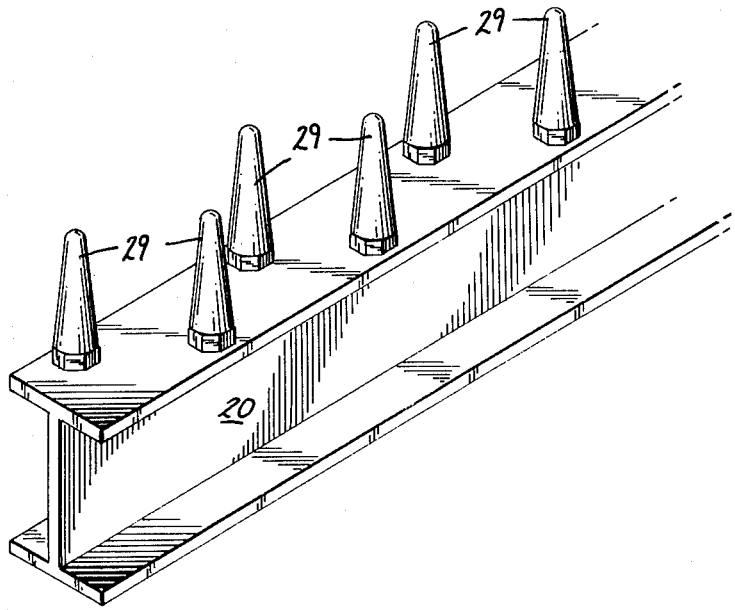
FIG. 7 is a fragmentary view in perspective of a portion of FIG. 3.

A plurality of projections or spikes 29 are bolted or otherwise attached to the portion of each rib member 20 which is located within the first breaking zone 23 and extend radially inward of the drum 11. The arrangement of spikes 29 on one such rib member 20 is illustrated in FIG. 7. In the preferred embodiment, each of the rib members 20 has two rows of spikes 29 associated with it. The spikes 29 are longitudinally spaced along the rib member 20 at approximately 12 inch intervals. The rows of spikes 29 associated with each rib member 20 are staggered so that the longitudinal distance between a spike 29 in one row and the next adjacent spike 29 in the second row is 6 inches. It is contemplated that the spikes 29 have a generally frusto-conical shape with a rounded tip portion. It will be understood, however, that other spacing arrangements and configurations of projections 29 may work equally as well.

Located rearwardly of the second breaking zone 24 is a grinding zone 30 having an annular cross section. The grinding zone 30 is defined by the space between a first sizing member 31, a portion of the wall of the drum and a divider plate 32. The first sizing member 31 consists of a first sizing screen 33 having a generally frusto-conical shape tapering in a rearward direction. The first sizing screen 33 is held in place by means of a first screen frame 34 which attaches the first sizing screen 33 at its forward edge to the interior wall of the drum 11 and at its rearward edge to an inner shell or cylindrical baffle 35. The inner shell 35 is a hollow, cylindrical member having both ends open and is located concentrically within the rear portion of the drum 11. The divider plate 32 takes the form of an annular disc located within the space between the interior wall of the drum 11 and the inner shell 35.

Located within the grinding zone 30 so described is a plurality of grinding balls 36. The divider plate 32 is provided with a plurality of openings of a size smaller than the grinding balls 36 so as to permit the passage of material from the grinding zone 30 through the divider plate 32 while maintaining the grinding balls 36 in the grinding zone 30.

In the preferred embodiment, it is contemplated that the first sizing screen 33 permit the passage of particles having a maximum size of approximately ⅜ inch. It is also contemplated that the grinding balls have a 2 inch diameter and that the holes in the divider plate 32 be 1½ inch in diameter staggered on 2½ inch centers. It will be understood, of course, that these sizes may be varied to meet particular requirements.

Located rearwardly of the grinding zone 30 is a second sizing screen 37 having a generally frusto-conical shape tapering in a rearward direction and being held in position by a second screen frame 38. The second screen frame 38 is supported away from the inner shell 35 by hold-down straps 39. The second screen frame 38 is attached to the interior wall of the drum 11 at the forward end of the second sizing screen 37 and to a subframe support member 40 at the rearward end of the second sizing screen 37. Sizing screen 37 has ⅛ inch openings. The subframe support member 40 extends radially inward from the interior wall of the drum 11 such that its outer periphery is attached to the inner wall of the drum 11 and its inner periphery attached to the second screen frame 38 thereby supporting said second screen frame 38 away from the interior wall of the drum 11. The subframe support member 40 is constructed so as to permit the passage of material therethrough.

The drum 11 has a plurality of openings 41 positioned around its circumference at the same longitudinal location as the second sizing screen 37. Each of the openings 41 is covered by a third sizing screen 42 which are there held in place by means of a third screen frame 43. In the preferred embodiment sizing screen 42 is a twenty mesh screen.

An end plate 44 is located at the rear end of the second subchamber 14 of the drum 11. The end plate 44 has the shape of an annular disc located between the wall of the drum 11 and the inner shell 35. A plurality of holes are provided in the end plate 44 to permit the passage of material from the drum. In the preferred embodiment, it is contemplated that these holes have a ½ inch diameter and be staggered on 1½ inch centers.

A housing 54 surrounds the rear portion of the drum 11. Within the housing 54 at the end of the drum 11 is a dust collector 56. The dust collector 56 consists of an outlet duct 57 which extends from within the inner shell 35 through the housing 54. The outlet duct 57 communicates with a vacuum pump (not shown) which, in operation, induces an airflow through the drum 11 in a front-to-rear direction. The airflow transports dust particles from within the drum 11 through the outlet duct 57 and into a collecting device (not shown) as is well known.

Also located within the housing 54 is an outlet chute 53, one end of which is positioned immediately adjacent the rear end of the drum 11. A collection box 55 is located immediately beneath the outlet chute 53.

In operation, material is fed into the drum 11 through the inlet port 19 by dropping it onto the inlet chute 18. As the drum is rotated, the material travels upward with the rotation of the rib members 20 until such time as it falls by means of gravity through the interior of the drum and impacts on the lower portion of the drum and the rib members 20 and associated spikes 29 located therein. The impact of the material with the rib members 20 and the spikes 29 serves to break down the material into smaller particles or chunks. Due to the fact that the drum is inclined at a slight angle, the natural flow of the material being processed is from the inlet to the rear portion of the drum 11.

The perforate partition 22 prevents the passage of the material being reclaimed from the first breaking zone 23 into the second breaking zone 24 until the material has been sufficiently broken down. In the second breaking zone 24, the breakdown of the material continues as the material reaches the first sizing member 31.

Upon reaching the first sizing member 31, the portion of the material which has been sufficiently broken down to pass through the first sizing screen 33 will fall through to the grinding zone 30 while that portion of the material which has not been sufficiently broken down to pass through the first sizing screen 33 will pass onto the inner shell 35 through the outlet chute 53 and out of the drum 11 as oversize. The oversize is collected in a collection box 55 and may be recycled through the apparatus for further refinement. The material which is able to penetrate the first sizing screen 33 will be subjected to further breakdown by the grinding action of the grinding balls 36 within the grinding zone 30. That material will thereupon pass through the divider plate 32 and onto the second sizing screen 37 which will further separate the material into particles of sufficiently small size to penetrate the second sizing screen 37 and oversize which will be discharged from the drum 11 through the end plate 44 and the outlet chute 53. The material which is able to penetrate the second sizing screen 37 will fall onto the third sizing screen 42 for even further classification. That material which is of sufficiently small size to pass through the third sizing screen 42 constitutes the finished product and will fall from the openings 41 in the drum 11 onto baffles 59 and then onto a conveyor belt 45 to be transported from the area of the drum 11. That material which is not able to penetrate the third sizing screen 42 will pass through the end plate 44 out of the drum 11 and into the collection box 55.

The separation of metal particles from the sand molds is also desirable. Those metal particles having sufficient size, of couse, will pass from the drum as oversize. It is contemplated that the conveyor belt system have a magnetic head pulley wherein the belt 45 is magnetized. Thus, the sand will fall from the belt upon reaching the end of the top portion while the metal particles will adhere to the belt. The metal particles may be removed from the belt by falling due to their own weight from the belt 45 at some point after the sand has fallen into the collection box 55.

While the preferred embodiment of the invention has been herein described, it will be understood that the scope of the invention will not be limited thereby but only by the appended claims.

What is claimed is:

1. Sand reclaiming apparatus comprising:

a. a longitudinal drum defining an internal chamber having first and second subchambers, said drum being mounted for rotation about a longitudinal axis;

b. means for rotating said drum;

c. inlet means communicating with said first subchamber;

d. a plurality of rib members located within said first subchamber and attached to the interior periphery of said drum, said rib members being spaced circumferentially therein and extending longitudinally of said drum;

e. partition means located within said first subchamber for dividing said first subchamber into first and second breaking zones, said partition means being constructed to permit only the passage of particles having a predetermined first maximum size therethrough;

f. a plurality of projection members attached to each of said rib members within said first breaking zone, said projection members extending inwardly within said drum;

g. first sizing means adjacent said second breaking zone for classifying material into a first part consisting of particles having a predetermined second maximum size and a second part consisting of oversized particles, said first sizing means in part defining a grinding zone containing a plurality of grinding balls;

h. second sizing means adjacent said grinding zone for further classifying the first part of material into a finished project and oversized particles;

i. first outlet means located in said second subchamber in communication with said second sizing means for discharging said finished product; and j. second outlet means located in said second subchamber in communication with said first and second sizing means for discharging said oversized particles.

2. Sand reclaiming apparatus according to claim 1 wherein said rib members comprise I-beams.

3. Sand reclaiming apparatus according to claim 1 wherein said partition means comprises a spider having a central hub portion and a plurality of arms spaced around said hub portion and extending outwardly therefrom, one end of each of said arms being attached to one of said rib members.

4. Sand reclaiming apparatus according to claim 1 wherein said projection members comprise spikes having a generally conical shape tapering radially inwardly within said drum.

5. Sand reclaiming apparatus according to claim 1 wherein said first sizing means comprises a first sizing screen attached to a first screen frame supported within said drum.

6. Sand reclaiming apparatus according to claim 1 wherein said second sizing means comprises:

a. a second sizing screen having a generally frustoconical shape and being attached to a second screen frame supported within said drum; and b. a plurality of third sizing screens spaced around the interior periphery of said drum and in communication with said first outlet means.

7. Sand reclaiming apparatus comprising:

a. a longitudinal drum defining an internal chamber having first and second subchambers, said drum being mounted for rotation about a longitudinal axis;

b. means for rotating said drum;

c. an inlet port located at one end of said drum and in communication with said first subchamber;

d. an inlet chute extending through said inlet port into said first subchamber;

e. a plurality of I-beams located within said first subchamber and attached to the interior periphery of said drum, said I-beams being spaced circumferentially therein and extending longitudinally of said drum;

f. a spider located within said first subchamber and dividing said first subchamber into first and second breaking zones, said spider comprising a central hub portion and a plurality of arms spaced around said hub portion and extending radially outwardly therefrom, one end of each of said arms being attached to said hub portion and the other end of each of said arms being attached to one of said I-beams;

g. a plurality of spikes attached to each of said I-beams within said first breaking zone, said spikes having a generally conical shape and extending inwardly within said drum;

h. a first sizing screen located adjacent said second breaking zone, said first sizing screen having a generally frustoconical shape and being attached to a first screen frame supported within said drum, said first sizing screen in part defining a grinding zone containing a plurality of grinding balls;

i. an inner shell located within said second subchamber of said drum, one end of said inner shell being attached to said first screen frame;

j. a second sizing screen positioned between said inner shell and said drum, said second sizing screen having a generally frusto-conical shape and being attached to a second screen frame supported between said inner shell and said drum;

k. a plurality of outlet openings within said drum located radially adjacent said second sizing screen; and l. a plurality of third sizing screens, one of said third sizing screens being positioned across each of said openings.

8. Method of reclaiming sand from foundry molds and the like comprising the steps of:

a. feeding the material to be reclaimed into a drum having an internal chamber defining first and second subchambers;

b. rotating said drum;

c. passing the material to be reclaimed through a first breaking zone within said first subchamber having projection members located therein;

d. classifying the material to be reclaimed into a first part consisting of particles having a predetermined first maximum size and a second part consisting of particles larger than said predetermined first maximum size;

e. passing said first part of material to be ground through a second breaking zone within said first subchamber;

f. classifying said first part of the material to be ground into a first portion consisting of particles having a predetermined second maximum size and a second portion consisting of oversized particles;

g. discharging said oversized particles from said drum;

h. grinding said first portion of said first part of the material to be reclaimed in a grinding zone containing a plurality of grinding balls;

i. classifying said first portion of said first part of the material to be reclaimed after it has been ground into a finished product having a predetermined third maximum size and oversized particles;

j. discharging the oversized particles from the drum; and k. discharging said finished product from the drum.

* * * * *

UNITED STATES PATENT AND TRADEMARK OFFICE

CERTIFICATE OF CORRECTION

PATENT NO. : 4,050,635

DATED : September 27, 1977

INVENTOR(S) : Edward E. Mueller et al

It is certified that error appears in the above-identified patent and that said Letters Patent are hereby corrected as shown below:

In line 5 of the Abstract, "inclinedfrom" should be --inclined from--.

Column 1, line 24, "has" should be --have--.

Column 6, line 1, "of couse" should be --of course--.

Column 6, line 47, "project" should be --product--.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*